United States Patent [19]

Johenning

[11] Patent Number: 5,050,257

[45] Date of Patent: Sep. 24, 1991

[54] EASY DRAINING WATERBED MATTRESS AND METHOD

[75] Inventor: John B. Johenning, Beverly Hills, Calif.

[73] Assignee: Strata Flotation, Inc., Torrance, Calif.

[21] Appl. No.: 569,094

[22] Filed: Aug. 17, 1990

[51] Int. Cl.[5] ..... A47C 27/08

[52] U.S. Cl. ..... 5/450; 5/451

[58] Field of Search ..... 5/451, 450, 449, 422, 5/452, 457, 458

[56] References Cited

U.S. PATENT DOCUMENTS

| | | | |
|---|---|---|---|
| 4,073,019 | 2/1978 | Fraser | 5/451 |
| 4,328,599 | 5/1982 | Mollura | 5/451 |
| 4,517,691 | 5/1985 | Phillips | 5/451 |
| 4,575,885 | 3/1986 | Hall | 5/451 |

*Primary Examiner*—Alexander Grosz

*Attorney, Agent, or Firm*—Flehr, Hohbach, Test, Albritton & Herbert

[57] ABSTRACT

Fiber-filled waterbed mattress and method of draining the same. A drainage manifold is positioned beneath a wave dampening fibrous insert to direct water toward a drain valve, and air is admitted into the mattress to replace water which is removed and to promote the drainage of water from the spaces between the fibers.

10 Claims, 2 Drawing Sheets

EASY DRAINING WATERBED MATTRESS AND METHOD

This invention pertains generally to waterbeds and, more particularly to the removal of water from a waterbed mattress having a fiber insert for reducing wave action.

One technique which has heretofore been employed to eliminate the wave motion which some people find objectionable in waterbeds is to place a fiber mat or pad inside the mattress. Such a pad typically consists of a mass of fibers, such as polyester fibers, and has a thickness on the order of 1-8 inches for a mattress having a thickness on the order of 8 inches. The floats in the water in the mattress and tends to damp out wave action before it can reach an objectionable level.

While a fiber insert can be helpful in reducing wave action, it can also make draining the mattress more difficult. Water tends to hang up between the fibers, and the insert may slide around inside the mattress and bunch up if a portion of the mattress is raised during the draining process. With the water trapped between the fibers, it is very difficult to get all, or substantially all, of the water out of the mattress even if a vacuum pump is employed.

It is in general an object of the invention to provide a new and improved waterbed mattress and method of draining the same.

Another object of the invention is to provide a waterbed mattress and method of the above character which enable water to be removed more easily and more completely than has heretofore been possible with fiber filled mattresses.

These and other objects are achieved in accordance with the invention by providing a waterbed mattress having a flexible bladder defining a chamber for holding water, a horizontally extending insert of fibrous material disposed in the chamber for reducing wave action in the water, a drain valve opening through the bladder for removing water from the chamber, and means forming a channel beneath the fibrous insert for directing water from the chamber toward the drain valve. In one disclosed embodiment, a plurality of drainage channels are formed by a sheet of foam having a fluted under side with openings in the foam for passing water from the fiber insert to the channels. In the preferred method of draining the mattress, water is drawn out of the mattress either by vacuum pump or by syphon, and air is admitted into the mattress to replace at least a portion of the water which is removed and to promote the drainage of water from the fibrous insert.

Figure 1:
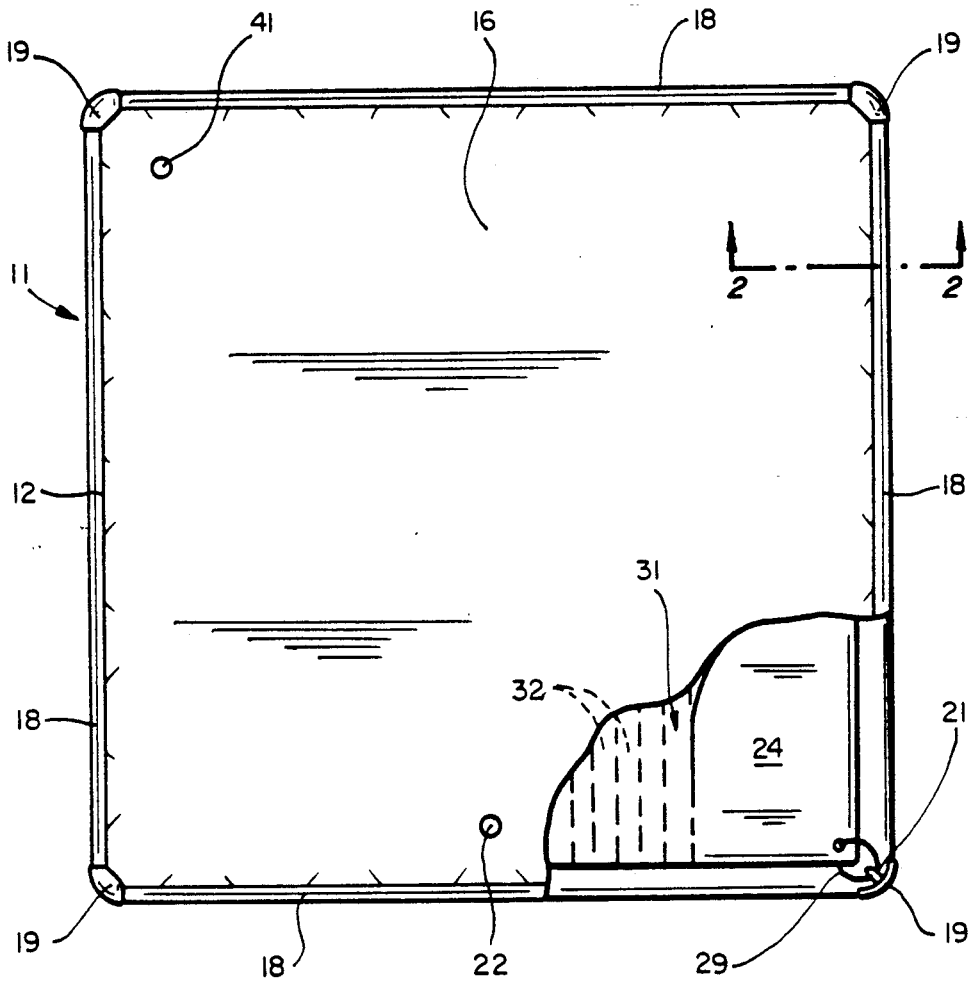
FIG. 1 is a top plan view, partly broken away, of one embodiment of a waterbed mattress incorporating the invention.
Figure 2:
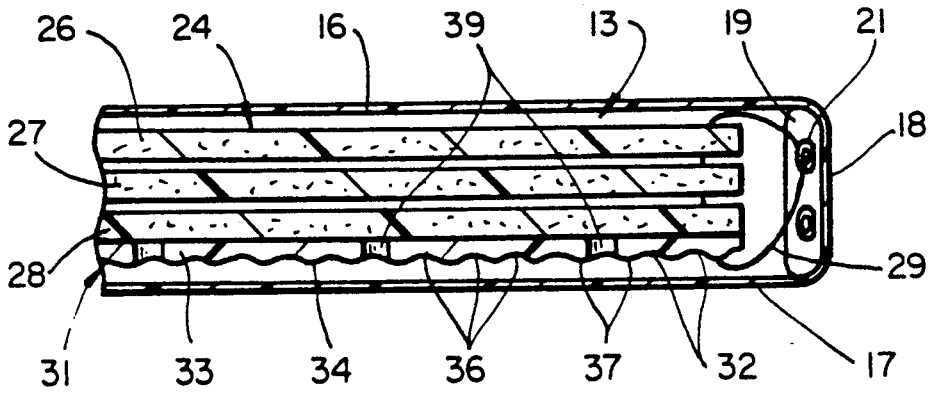
FIG. 2 is an enlarged fragmentary cross-sectional view taken along line 2—2 in FIG. 1.

In FIGS. 1-2, the invention is illustrated in connection with a generally rectangular waterbed mattress 11 having a flexible bladder 12 defining a chamber 13 for holding water (not shown) for buoyantly supporting persons resting thereon. The mattress has a top wall 16, a bottom wall 17 and side walls 18 which are fabricated of a flexible, water impervious material such as 20 mil polyvinylchloride. At the corners, the bladder has relatively heavy cornerpieces 19 of the type disclosed in U.S. Pat. No. 4,930,172, and in Ser. No. 490,130, filed Mar. 6, 1990, now abandoned. These cornerpieces have relatively thick (e.g. 40-80 mil) base plates with cleats or ridges projecting therefrom to provide protection against punctures and abrasive wear as well as to help to retain bedsheets in position on the mattress. The cornerpieces also have inwardly projecting eyelets or grommets 21 for receiving tether straps.

A valve 22 is mounted in the top wall of the bladder for filling and draining the mattress. This valve is of conventional design, and it typically has an opening with a removable plug or cap controlling communication through the opening.

A fibrous insert 24 is disposed in chamber 13 to reduce the wave-like motion of water in the mattress. In the embodiment illustrated, the insert consists of three horizontally extending pads or mats 26-28 of a fibrous material such as polyester fibers which float in the water in the chamber. Each of the pads or mats has a lateral extent corresponding to the top wall of the mattress, and the insert is retained in position within the chamber by tether straps 29 connected to eyelets or grommets 21.

A drainage manifold 31 having a plurality of drainage channels 32 is positioned beneath the fibrous insert to facilitate the removal of water from the mattress. The channels extend toward the drain valve, and with the valve located in a central position toward one end of the mattress, the channels extend in a longitudinal direction, i.e. lengthwise of the bed.

In the embodiment illustrated, the drainage manifold comprises a horizontally extending pad 33 of polyethylene foam with a fluted lower surface 34 having alternately disposed ridges 36 and valleys 37 defining the drainage channels. The foam pad is affixed to the under side of the lowermost pad or mat 28 in the fibrous insert by rivets or other suitable means. To facilitate the passage of water from the fibers to the channels, drainage holes 39 are formed in the foam pad. These holes have a diameter on the order of ½ inch and are spaced apart by a distance on the order of 6-12 inches. The foam pad has an overall thickness on the order of ¼ inch, and the ridges and valleys which form the channels have a height or depth on the order of ⅛ inch.

The foam pad with the fluted lower surface is conveniently formed by an extrusion process, but the manifold can be formed of any suitable material which is impervious to water, and the channels can be formed by any suitable technique. The channels can also be arranged in a pattern other than straight parallel lines for directing water toward the valve. While the foam pad is illustrated as extending substantially the full width of the fibrous insert, it is also possible to use a manifold of lesser width, with some reduction, however, in drainage efficiency.

If desired, a second valve 41 can provided to admit air to replace water which is removed and to promote the drainage of water from the fibrous insert. This valve can be similar in construction to valve 22, and in the embodiment illustrated, it is mounted in the top wall of the bladder toward the opposite end of the mattress from valve 22.

When the mattress is filled with water, the relatively thin foam pad floats with the fibrous insert and does not interfere with the wave dampening action of the insert.

In a preferred method of draining the mattress, a hose or line (not shown) is connected to valve 22 and/or inserted into the interior of the mattress through this valve, and water is drawn out of the mattress through the hose either by a pump or by syphoning. Any suitable pump can be used, and a venturi pump has been found to be particularly effective for this purpose. As the water is removed from the mattress and the fibrous insert sinks toward the bottom wall, the channels formed in the lower surface of the foam pad remain open to carry the water toward the drain valve. Even before the foam pad contacts the bottom wall, the channels help to direct the flow of the water toward the valve. The tether straps prevent the fiber insert from shifting within the mattress and are helpful in keeping the drainage channels properly aligned and free from obstructions during the drainage process.

As the water is remove from the mattress, air is admitted to replace at least a portion of the water and to promote the drainage of water from the fiber mats. The water tends to hang up in the spaces between the fibers, and when the air is admitted, trapped water pools or collects until the weight of the collected water causes it to fall from the fibers. This water then passes through the holes in the foam pad into the channels from which it is easily removed.

When only one valve is used, the air is admitted by stopping the pump or syphon and temporarily removing the drain hose from the valve so that air can enter the mattress through the valve. This is best done when the water has been removed to the point where the mattress appears to be almost drained. Once the air is admitted, the hose is reinserted, and the pump or syphon is restarted to remove the rest of the water.

In mattresses having a second valve, that valve can be opened at the outset, and air can be admitted continuously through that valve during the draining process without having to remove the hose or interrupt the draining operation.

Figure 3:
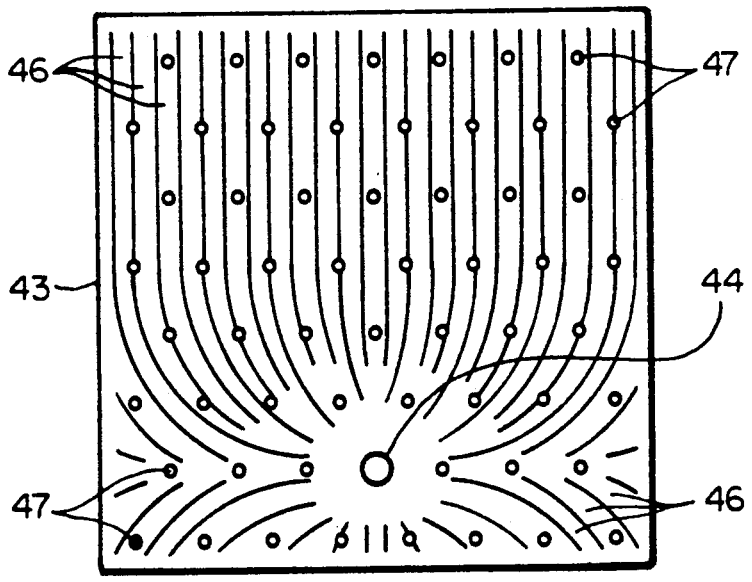
FIG. 3 is a bottom plan view of another embodiment of drainage manifold for use in a waterbed mattress according to the invention.

FIG. 3 illustrates an embodiment of a drainage manifold having a plurality of channels which direct the water to a central location below the drain valve 22. This manifold comprises a horizontally extending sheet of foam 43 having a drain hole 44 extending therethrough in registration with the drain valve. The foam sheet is mounted on the under side of the fibrous insert as in the embodiment of FIGS. 1–2, and channels 46 are formed in the lower surface of the foam sheet with openings 47 in the sheet for passing water from the fibers to the channels as in the previous embodiment. Rather than simply being parallel to each other, however, channels 46 extend toward and terminate near drain hole 44 so that water carried by the channels is delivered to a point directly beneath the drain valve for removal from the mattress.

Manifold body 43 can be fabricated of any suitable material such as polyethylene foam, semi-rigid polyvinylchloride, polypropylene or polyethylene, and channels 46 can be formed by any suitable method such as vacuum forming or pressure forming.

In use, channels 46 carry the water from the fibrous insert to a point beneath drain valve 22, from which it is drawn in an upward direction through drain hole 44, through the fiber mats and through the hose connected to the drain valve.

The drainage channels and method of the invention have been found to be very effective in removing water from a fiber-filled mattress. A test mattress similar to mattress 11 but without the drainage manifold and channels was drained with a venturi pump using the conventional technique for draining such mattresses. After more than three hours, the mattress was weighed, and it was found that approximately 40 pounds of water still remained in the mattress. In a similar mattress with the drainage manifold and channels, only 25 pounds of water remained after three hours of pumping with the standard drainage technique, and when the drainage method of the invention was employed with this mattress, only 15 pounds of water remained after three hours of pumping.

It is apparent from the foregoing that a new and improved waterbed mattress and method of draining the same have been provided. While only certain presently preferred embodiments have been described in detail, as will be apparent to those familiar with the art, certain changes and modifications can be made without departing from the scope of the invention as defined by the following claims.

I claim:

1. In a waterbed mattress: a flexible bladder defining a chamber for holding water, a horizontally extending insert of fibrous material disposed in the chamber for reducing wave action in the water, a drain valve opening through the bladder for removing water from the chamber, a horizontally extending drainage manifold positioned beneath the fibrous insert and having a plurality of channels formed therein for receiving water from the fibrous insert and carrying said water toward the drain valve.

2. The waterbed mattress of claim 1 wherein the drainage manifold has a horizontally extending lower surface in which the channels are formed and a plurality of openings communicating with the channels for carrying water from the fibrous insert to the channels.

3. The waterbed mattress of claim 1 wherein the drainage manifold comprises a foam pad having a fluted lower surface in which the channels are formed.

4. The waterbed mattress of claim 1 including means tethering the insert to the bladder to hold the insert in a predetermined position within the bladder as water is removed from the chamber.

5. The waterbed mattress of claim 1 including a second valve in the bladder for admitting air into the chamber as water is removed therefrom.

6. The waterbed mattress of claim 1 wherein the drainage manifold is affixed to the lower side of the fibrous insert.

7. In a waterbed mattress: a flexible bladder defining a chamber for holding water, a horizontally extending insert of fibrous material disposed in the chamber for reducing wave action in the water, a drain valve positioned toward one end of the bladder for removing the water from the chamber, and a foam pad affixed to the under side of the fibrous insert and having a fluted lower surface with a plurality of alternately disposed longitudinally extending ridges and valleys forming a plurality of longitudinally extending channels beneath the fibrous insert for carrying water from the chamber toward the drain valve.

8. The waterbed mattress of claim 7 wherein the drain valve is mounted in an upper wall of the bladder.

9. The waterbed mattress of claim 7 including means tethering the insert to the bladder to hold the insert in a predetermined position within the bladder as water is removed from the chamber.

10. The waterbed mattress of claim 7 including a second valve positioned toward a second end of the bladder for admitting air into the chamber as water is removed therefrom.

* * * * *